United States Patent [19]

Stickler

[11] Patent Number: 4,477,332

[45] Date of Patent: Oct. 16, 1984

[54] SOLUBILIZATION OF CARBONACEOUS MATERIAL

[75] Inventor: David B. Stickler, Carlisle, Mass.

[73] Assignee: Avco Everett Research Laboratory, Inc., Everett, Mass.

[21] Appl. No.: 516,519

[22] Filed: Jul. 25, 1983

[51] Int. Cl.[3] ..... C10G 1/00; C10B 43/00

[52] U.S. Cl. ..... 208/8 R; 201/2.5

[58] Field of Search ..... 208/8 R; 201/2.5

[56] References Cited

U.S. PATENT DOCUMENTS

| | | | |
|---|---|---|---|
| 3,843,457 | 10/1974 | Grannen et al. | 201/2.5 |
| 4,056,602 | 11/1977 | Matovich | 423/345 |
| 4,057,396 | 11/1977 | Matovich | 201/2.5 X |
| 4,118,282 | 10/1978 | Wallace | 208/8 R X |
| 4,151,044 | 4/1979 | Choi | 201/12 |
| 4,158,552 | 6/1979 | Blaskowski et al. | 48/210 |
| 4,166,786 | 9/1979 | Duraiswamy et al. | 208/8 |
| 4,206,032 | 6/1980 | Friedman et al. | 208/8 |
| 4,243,489 | 1/1981 | Green | 201/12 |
| 4,260,456 | 4/1981 | Schulman | 201/12 |
| 4,304,656 | 12/1981 | Lee | 208/11 R |
| 4,376,034 | 3/1983 | Wall | 208/8 R X |

*Primary Examiner*—Delbert E. Gantz
*Assistant Examiner*—William G. Wright
*Attorney, Agent, or Firm*—M. E. Frederick

[57] ABSTRACT

Pulverized carbonaceous material such as coal while flowing through a reactor dispersed in a carrier gas substantially transparent to radiant energy and at atmospheric pressure is heated, typically for a few milliseconds to about 1500° K., by thermal radiation while maintained in the cooler carrier gas to selectively heat the pulverized material, while cooling the volatile products as they diffuse into the cooler carrier gas, followed by quenching where necessary. In the case of coal, the principal result of this treatment is a radical increase in the easily soluble fraction of the coal with substantially no net change in the solid ultimate or proximate characteristics and substantially no output gaseous volatile production. The pulverized material and any condensed soluble fraction may then be subjected to solvent treatment with a solvent such as, for example, tetrahydrofuran (THF) or other suitable solvent to collect the soluble fraction which may then be subsequently separated and processed in conventional manner to produce moderate molecular weight organic compounds, liquid fuels and the like. The remaining insoluble fraction may, for example, be burned for process heat, used as a hydrogen source, or desulfurized by hydrogenation.

13 Claims, 4 Drawing Figures

SOLUBILIZATION OF CARBONACEOUS MATERIAL

This invention relates to the treatment of carbonaceous materials to produce in soluble form moderate molecular weight organic compounds and products suitable for conversion to fuels and the like.

DESCRIPTION OF THE PRIOR ART

Carbonaceous materials such as coal, peat, biomass and the like are typically processed to produce hydrocarbon liquid and gaseous products via three general routes. These routes are (1) high pressure hydrogenation in a solvent at moderate pressure, (2) reaction in hot flowing hydrogen ($H_2$), and (3) gasification to hydrogen ($H_2$) and carbon monoxide (CO) followed by hydrocarbon synthesis. All three of these routes have intrinsic limitations associated with throughput, efficiency, product selectivity and cost.

A basic issue found in pyrolysis of particulate coal is associated with pyrolysate behavior in the gas phase after leaving the particle. As used herein, the term "particulate" means a particle having at least one dimension not greater than about 200 microns. Practice to date involves providing heat input to the particles from a hot gas with the result that the pyrolysate diffuses into a hot environment. It is observed to decompose, typically to soot and hydrogen or low molecular weight species, in this environment. Alternatively, a hot reactive atmosphere can give essentially an equilibrium gas composition. A high concentration of steam results in a synthesis gas product, $CO+H_2$, while a hydrogen atmosphere forces formation of aromatics, methane, or acetylene, depending on process conditions. All of these routes result in substantial destruction of the volatile matter organic structure in the process of equilibrium stabilization or sooting.

Extensive research, development, and demonstration efforts have been made over the past decade aimed at producing clean liquid fuels from coal. While technologically successful, none of these approaches appear to offer attractive economic leverage for unsubsidized commercial adoption. One factor directly controlling product cost is the large quantity of hydrogen used in these processes, and the large hydrogen gas recycle, requiring cleanup processes. Although pretreatment of coal by direct liquefaction processes shows potential for the production of transportation fuels, such upgrading is costly due to a requirement for production and consumption of substantial quantities of hydrogen. Less severe hydrogenation produces fuel qualities that satisfy only stationary operations such as power stations. As a result of this, direct utilization of coal, despite attendant emission control costs, has continued to be developed for stationary applications. Transportation fuels remain almost totally petroleum derived.

In direct liquefaction processes currently under development, such as H-Coal, SRC, and Exxon Donor-Solvent, coal is processed as a slurry in a coal-derived solvent. Typically, a high partial pressure of hydrogen gas (600–900 psig) and a temperature (750°–850° F.) sufficient to cause hydrogenation at a reasonable rate but not so high that degradation by-products are produced excessively is required. In such processes a coal is treated under a set of specified conditions for a relatively long residence time (typically thirty minutes) during which there are produced a wide range of hydrocarbon types. The selected operating conditions are a compromise of severities for the variety of hydrocarbon species present in the coal. As a result, the yield of preferred products in current liquefaction technology is constrained. Also, efficient preferential utilization of hydrogen for desulfurization and denitrogenation is limited. Both excessive saturation of condensed phase products, and conversion to low molecular weight gaseous products occurs. Overall coal carbon conversion to preferred "liquid" products generally falls in the range of about forty to sixty percent, depending primarily on the severity of the process conditions. The residual carbon is a char-like material, containing the bulk of the original coal ash.

Coal liquefation processes such as noted above are distinct from the relatively well-developed technology of selective treatment of petroleum fractions. In commercial practice, desulfurization of fuels in the petroleum industry is accomplished by obtaining selected boiling range hydrocarbons directly from crude petroleum. They are separately treated with hydrogen to achieve chemical rearrangements as in reforming of lighter fractions, or to achieve desulfurization in intermediate boiling range fractions, or to achieve controlled hydrocracking of the heavy petroleum fractions. In each case the operating conditions are selected with a specific objective in mind for a well-defined feedstock. By this means, operating conditions can be controlled within cost-effective ranges, excessive carbon is not produced, and hydrogen is more accurately directed at the preferred conversion or upgrading goal.

U.S. Pat. No. 4,056,602, issued Nov. 1, 1977 and entitled "High Temperature Chemical Reation Processes Utilizing Fluid-Wall Reactors" discloses processes utilizing radiation coupling as a heat source, maintaining the high overall temperature chemical reaction within a gaseous blanket transparent to the radiant energy, and providing exterior heat shielding means to enclose the radiant energy heating means and reaction zone to define a thermal radiator cavity. A reactant flow, which may be pulverized coal, is passed through the reaction zone. Sufficient radiant energy is absorbed by the reactant flow to raise its temperature to a level required to carry out the desired high-temperature chemical reaction, such as gasification in the case of coal. In the event the reactant flow is transparent to the radiant energy, an absorptive target material may be added to raise the temperature in the reaction zone to the desired level by convection and/or re-radiation from the target material. Cooling of reaction products at the outlet of the reaction zone, where necessary, is contemplated to prevent reversal of the reaction process.

Because heat is introduced by radiation coupling through an inert and heat transparent gaseous blanket, the temperature of the reactant flow may be independent of both the temperature of the reactor wall and the condition of the reactant flow, thereby reducing the strength of materials problem of the reactor wall and build-up of char or minerals on the reactor wall.

SUMMARY OF THE INVENTION

Pulverized carbonaceous material such as coal while flowing through a reactor dispersed in a carrier gas substantially transparent to radiant energy and at atmospheric pressure is heated, typically for a few milliseconds by thermal radiation in the cooler carrier gas to selectively heat the pulverized material to about 1500° K., while cooling the volatile products as they diffuse into the cooler carrier gas, followed by quenching where necessary. In the case of coal, the principal result of this treatment is a radical increase in the easily soluble fraction of the coal with substantially no net change in the solid, ultimate, or proximate characteristics, and substantially no output gaseous volatile production. The pulverized material, together with any condensed fraction, are then subjected to solvent treatment with a solvent such as, for example, tetrahydrofuran (THF) or other suitable solvent to collect the soluble fraction. This process of solubilization does not require any added hydrogen, unlike other liquification processes. The soluble fraction may then be substantially separated and processed in conventional manner to produce moderate molecular weight organic compounds, liquid fuels, and the like. The remaining insoluble fraction may, for example, be burned for process heat, used as a hydrogen source, or desulfurized by hydrogenation.

Although the carrier gas flow transporting the pulverized material will unavoidably be heated to some extent by diffusive transport and convection (pyrolysate blowing) from the pulverized material, proper choice of particle size, number density, gas density, heater thermal emissive characteristics and the like are selected in accordance with the invention to result in maximum practical solubilization of the pulverized material while simultaneously providing the maximum practical temperature difference (of several hundred degrees or more Kelvin) between the material and its surrounding gas. In addition to the carrier gas, a shielding gas substantially transparent to the incident radiation may be flowed along the walls, not to protect the walls or prevent build-up on these walls, but to insulate to the greatest extent reasonably possible, the particles and the carrier gas from contact with the high temperature walls and thereby prevent excessive and undesirable heating of the carrier gas containing particles contrary to the desired relationship existing in the central portion. Further, the material comprising the thermal heat radiator preferably is chosen that has a spectral emissivity distribution that results in maximum heating of the pulverized material and minimum heating of condensed volatiles and thereby keeps polymerization of condensed volatiles and continued heating of condensed volatiles at a minimum.

This approach to coal treatment for liquefaction is based upon a conseptual model of physical events. In this model, coal decomposes chemically and/or physically to give a residual solid carbonaceous material, together with minerals, and a primary volatile material, comprised largely if not entirely of moderate molecular weight organic compounds, similar to the so-called tars commonly observed. The division between residual material and volatile material depends in a complex manner on coal type, heating environment, and gas atmosphere. Further, the behavior of the primary volatile organic compounds is strongly affected by the environment external to the coal particle. In the present invention, the gas surrounding and carrying the coal particles is maintained at low temperature, by avoidance of strong direct heating of it. Consequently, the primary volatile vapors produced by the radiatively heated coal particles diffuse into a cooler gas very rapidly, and consequently are cooled by mixing with cooler gas, and cease to react or decompose chemically. In the event that a high concentration of these cooled primary volatile species develops locally, they may nucleate and condense, forming organic condensate droplets dispersed in the cool carrier gas. These are typically much smaller than the original coal particles. They may remain as liquid or solid droplets, or be heated to a moderate temperature by the thermal radiation flux, and react further, for example by crosslinking to form small polymer particles. This in accordance with the present invention can be avoided where necessary by carefully tailoring the thermal radiation heating spectrum. Collection of the process stream results in capture of all condensed phase material, togehter with condensation of the dispersed volatile vapors. Since this occurs at low temperature, and may be done in the presence of a solvent, no significant further chemical reaction occurs. Subsequent solvent extraction separates the soluble organic materials produced by thermal isolation, from the residual solid carbonaceous and mineral materials.

The present invention provides a new and novel technique for obtaining high yields of soluble products from coal and the like without the use of hydrogen or severe solvent treatment conditions, thereby resulting in a substantial decrease in the cost of production of clean fuels from coal and the like.

The separation of coal or the like by solubilization in accordance with the present invention into two principal and separate portions permits each portion, and especially the soluble portion, to be upgraded to meet commercial specifications at minimum cost by using technologies similar to those developed and/or in commercial use in the petroleum industry. Separate treatment of the soluble and insoluble portions of coal or the like in accordance with the invention permits selectivity in determining treatment and at the same time, control of the extent of the by-product list. This permits reduction of gaseous by-product formation and a radical reduction in total hydrogen consumption. This also permits organic sulfur compounds to be effectively separated from pyritic sulfur by the solubility operation. Commercial practices may be largely, if not directly, used to achieve desulfurization of the soluble portion. The insoluble portion may, if desired, be separately treated under more severe conditions to effect desulfurization.

Optimization of coal or other carbonaceous material choice, heating, solvent extraction treatments and the like provide maximum yield of soluble product comprising a major portion of the coal, without requirement for hydrogenation. Accordingly, only a small portion of the original coal as insolubles will require the relatively more severe hydrogenation conditions for elimination of pyritic sulfur where desired. Thus, total hydrogen required for coal processing is reduced proportionately, with a net reduction in capital and operating costs. Of course, if desired the insoluble portion may be used onsite for hydrogen production and/or process heat.

BRIEF DESCRIPTION OF THE DRAWINGS

Referring now to FIG. 1, there is shown in schematic form a process flow in accordance with the invention. Pulverized coal or other carbonaceous material dispersed in a carrier gas or the like is introduced into a heat exchanger where it is heated for a few milliseconds by thermal radiation in a cooler background carrier gas to produce a soluble fraction and an insoluble fraction, followed by quench (if required) and solvent treatment of the now modified coal structure. The soluble fraction is treated as a starting point for further processing which may involve heteroatom removal, and upgrading, if appropriate. The insoluble fraction may be burned with air for process heat, used as an hydrogen source, or desulfurized by hydrogenation. About fifty percent or more direct yield of soluble de-ashed product material may be expected, as well as excess fuel value from the insoluble fraction, without any expenditure of hydrogen.

The thermal radiation may be produced in several conventional ways. Thus, heating of a suitable and conventional body may be derived from direct heat transfer from combustion products, e.g., of char with air, as suggested in FIG. 2. This type of approach imposes an upper bound on wall temperature of the order of 1800° K., assuming the use of advanced technology silicon carbide tubes and the like as radiators. An alternate approach shown in FIG. 4 may include electrically heating the radiating elements, using graphite or silicon carbide, for example, as the working material. Electrically heating allows operation at significantly higher thermal radiator temperature, e.g., of the order of about 2500° K. This approach has the advantage of giving a more intense radiative flux, which results in more rapid coal heating, and less temperature rise of the surrounding gas as the coal heats up. The energy requirement for this approach is essentially that of heating of the pulverized coal, e.g., from a mass averaged temperature of about 300 ° to about 1500° K., plus a bulk gas mass averaged temperature at the reactor exit in the range of about 300 ° to about 1000° K. Assuming a coal carbon to diatomic gas ratio of one (molar), the basic thermal energy requirement may be expected to be about 11 Kcal per mole of coal carbon. Assuming fifty percent soluble product yield, and electrical power generation from the insoluble fraction at a net efficiency of thirty-five percent, available electrical power will be about twice the required process heat. Overall radiator temperature range may be expected to be in the range of about 2500° K. Consequently, an electrically based radiative heating process is not unrealistic, even when ignoring internal heat recovery and keeping in mind that primary near term interest is quite likely to center on lower temperature regimes, which are compatible with direct combustion based heat exchange.

Figure 2:
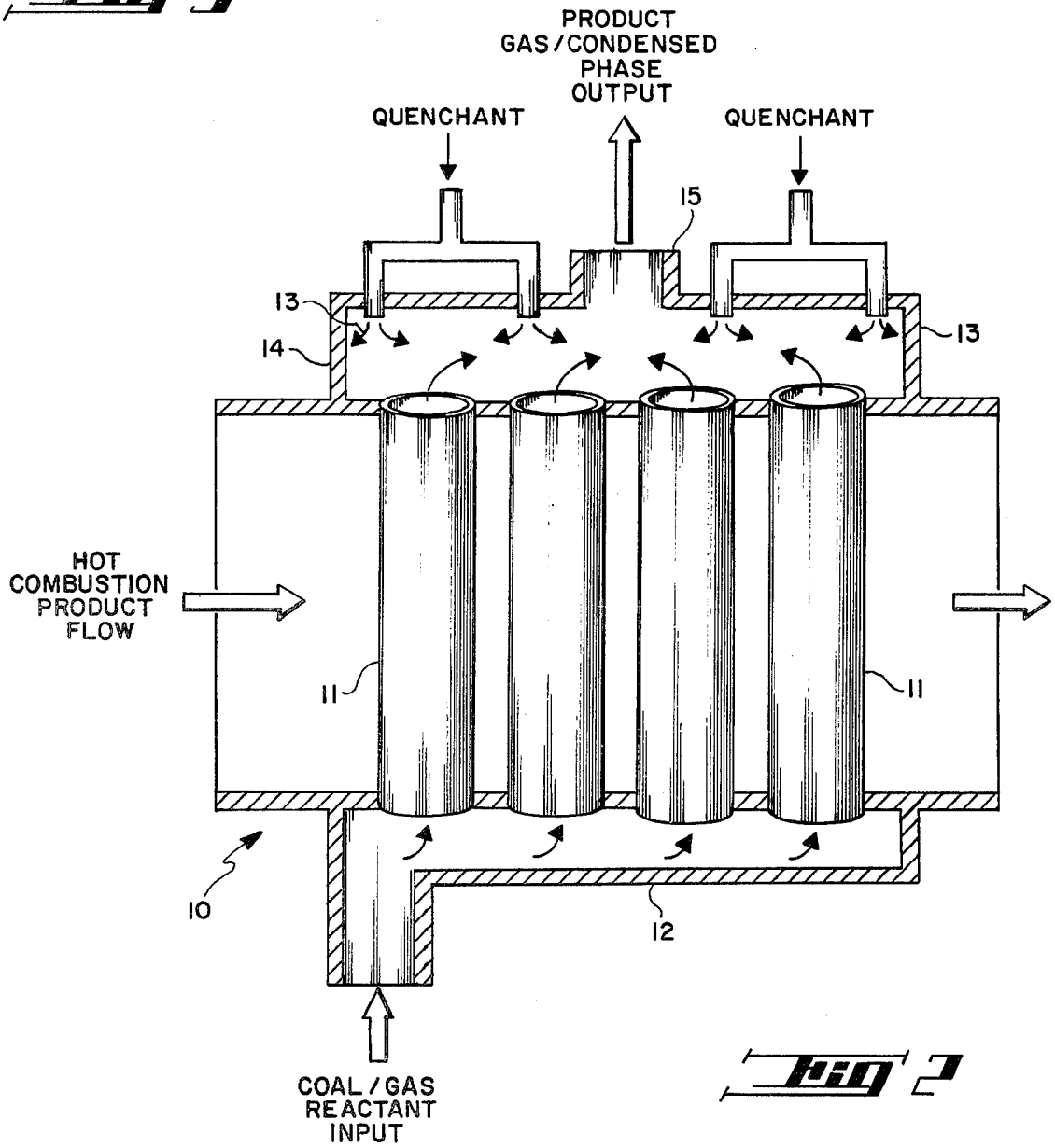
FIG. 2 is a diagrammatic illustration of apparatus heated by direct heat transfer for carrying out the invention.

As shown in FIG. 2, a heat exchange fluid such as, for example, hot combustion gases is introduced into a heat exchanger 10 including flow reactor tubes 11 arranged and adapted in conventional manner to provide maximum flow of the hot combustion products around the tubes to preferably substantially uniformly heat them to the highest practical temperature and cause them to function as thermal radiators. Use of an array of such flow reactor tubes in a hot-walled flow enclosure minimizes external radiative heat loss.

Pulverized coal in a carrier gas is introduced into an inlet manifold 12 and caused to flow through the reactor tubes 11. A quenchant flow 13 where necessary may be provided in the outlet manifold 14. The soluble and insoluble fractions dispersed in the carrier gas leave the reactor via an outlet pipe 15.

Figure 1:
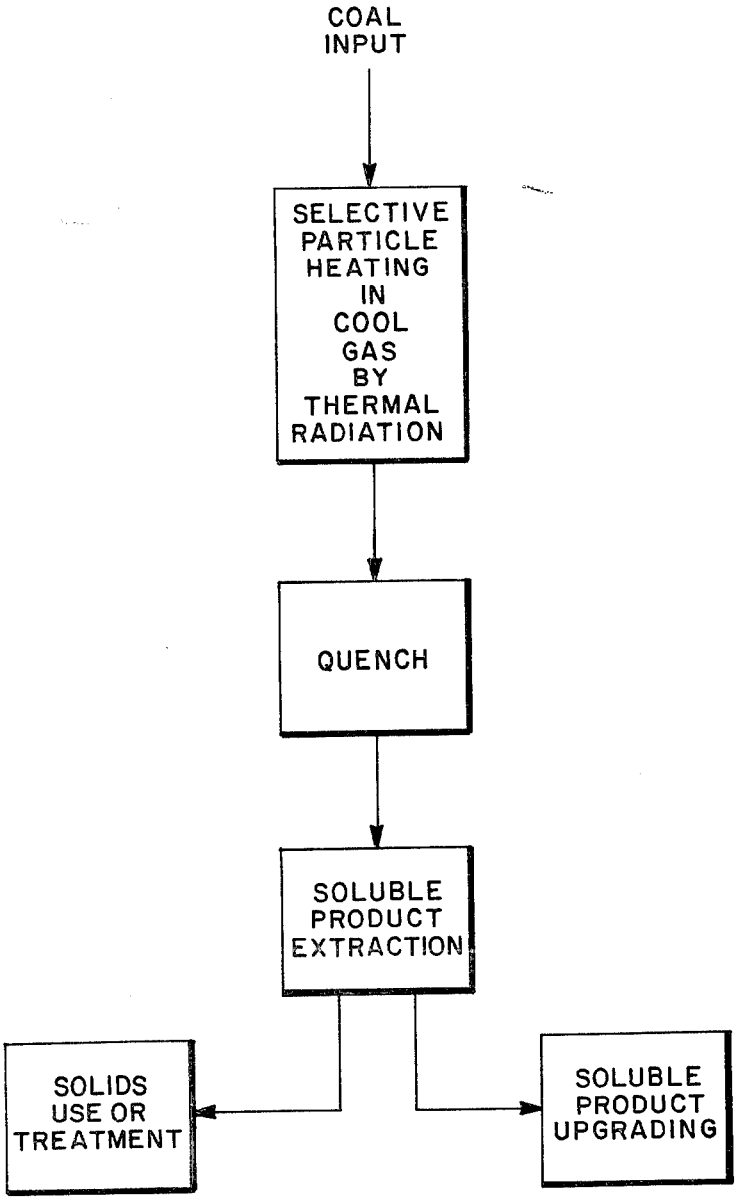
FIG. 1 schematically illustrates a process flow in accordance with the invention.
Figure 3:
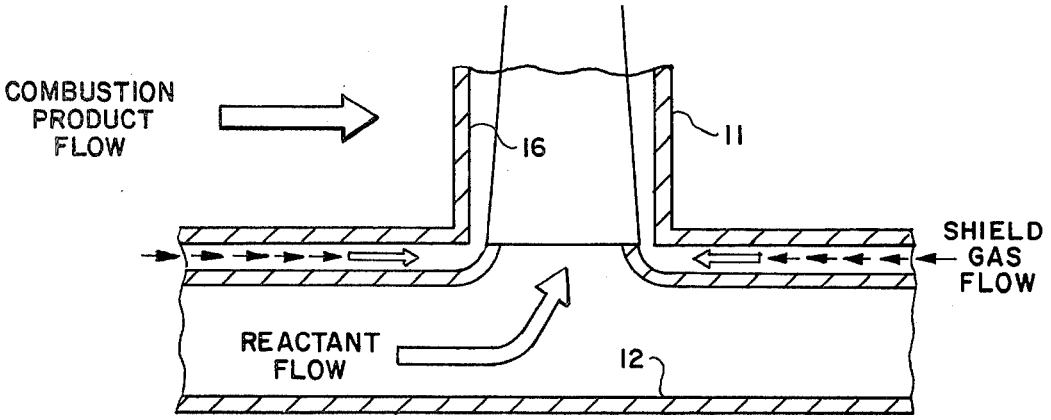
FIG. 3 is a fragmentary view illustrating the provision of a shielding gas flow to reduce heat transfer to the carrier gas.

FIG. 3 is a fragmentary view on an enlarged scale illustrating the provision of a flow of shielding gas along the inside surfaces 16 of the reactor tubes 11 to reduce heat transfer from the reactor tube walls to the carrier gas. Thus, as the shield gas flows from the inlet to the outlet of each reactant tube, it provides a thermal boundary layer effective to maintain the carrier gas temperature at a level lower than that at which it would otherwise be at if the carrier gas were 12 in continuous contact with the hot reactor tube walls.

Figure 4:
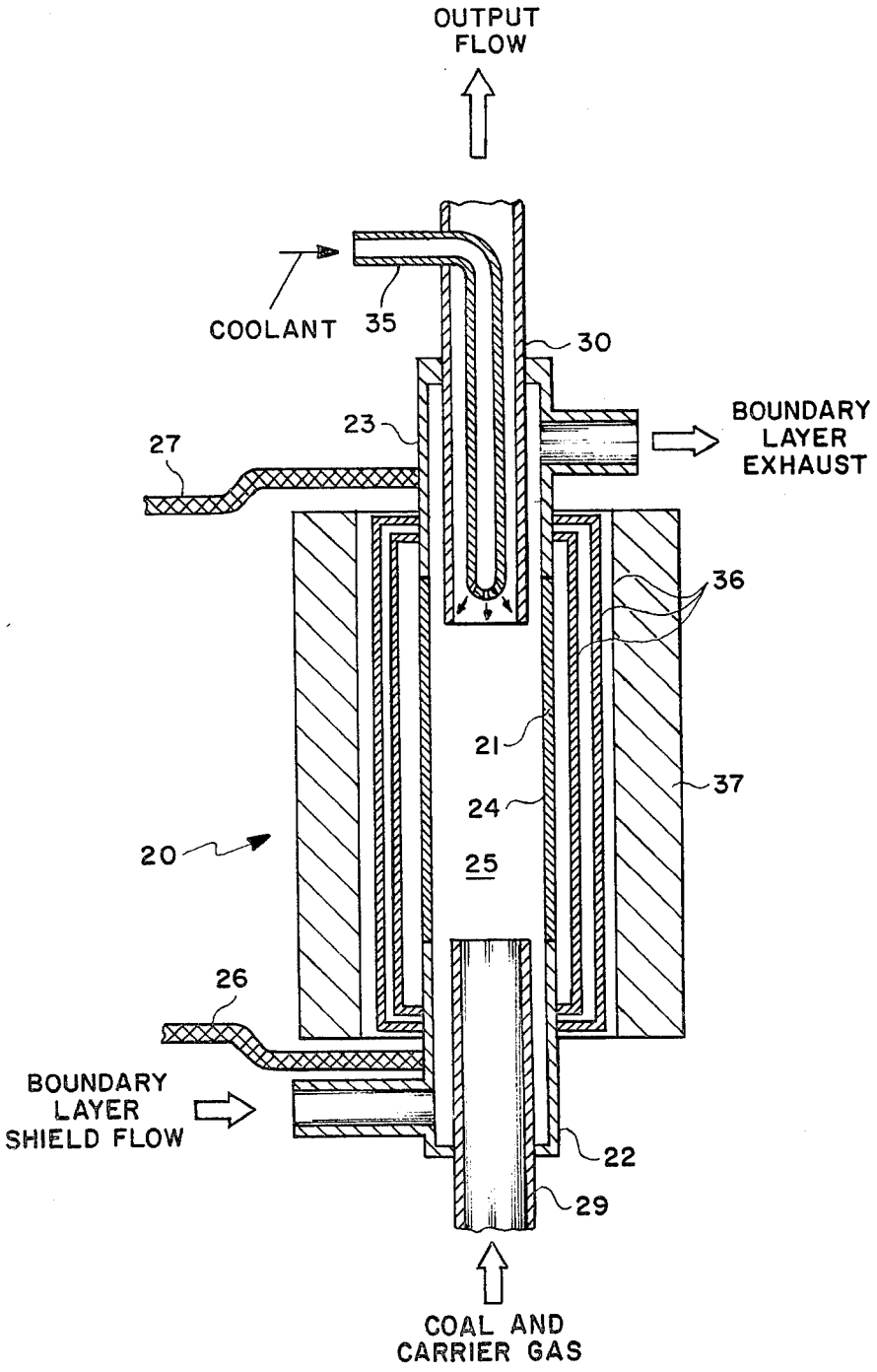
FIG. 4 is a diagrammatic illustration of electrically heated apparatus for carrying out the invention.

Attention is now directed to FIG. 4 which illustrates an electrically heated radiative heating flow reactor 20 comprising a resistive heater reactor tube 21 having an inlet end 22 and an outlet end 23. The center portion 24 of the tube 21 defines a reaction chamber 25. The center portion 24 of tube 21 is made of graphite or the like to function as an electrical heater, whereas the end portions 22 and 23 may be composed of a low resistance material such as stainless steel or the like. The end portions 22 and 23 are coupled to a source of electrical power (not shown) via conductors 26 and 27. Pulverized coal or the like in a carrier gas is introduced to the interior of tube 21 via an inwardly projecting inlet pipe 29 and exhausted via an inwardly projecting outlet pipe 30. Means such as a coolant pipe 35 may be disposed in the outlet pipe 30 to quench the exiting fractions. Boundary layer shielding gas is introduced at the inlet end 22 of tube 21 and exhausted at the outlet end 23 of tube 21 in such a manner as to keep the reactant and carrier gas spaced away from the high temperature tube. Tube 21 is surrounded by radiation shields 36 which are in turn surrounded by insulation 37.

For a more detailed discussion of suitable electrically heated apparatus, reference is made to U.S. Pat. No. 4,056,602 which is incorporated herein as if set out at length.

While cylindrical tubes are shown by way of example, it is to be understood that other configurations may be used, such as, for example, hexagonal or rectangular cell arrays or parallel flat plates, employing either a hot gas flow heat source in some of the resulting ducts, or electrical heating of the structure.

In order to limit heating of the carrier gas by heating from the reactor tube wall, so that the gas may be maintained at the lowest practical temperature, the reactor tubes should be cylindrical and have a length to diameter (L/D) ratio of the order of about five. The coal particles should be fairly uniformly distributed in the carrier gas and should be exposed to a fairly uniform radiation field. This latter condition may be reasonably accomplished if reactor tube diameter is limited to about 10–20 cm, with appropriate loading and size distribution of the pulverized carbonaceous material. Residence time for heating should be in the range of about twenty milliseconds with a flow velocity significantly greater than particle settling velocity. This may result in a reactor tube length of about 50–100 cm. Radiative and conductive end losses to cooled components will, of course, result in a significant temperature gradient at the ends of the reactor tubes which will have to be taken into account in selecting a reactor tube length. Coal particle and background gas temperature depend on particle size distribution, loading and radiative heating flux. Residence time and peak temperature depend on gas flow rate and position of cooled exit ducts and quench assembly. The composition range of the soluble fraction may be controlled by choice of background gas temperature and composition, residence time in the reactor section and flow time after heating but prior to any quench, and quenchant composition.

In accordance with the invention, the particles should be heated to a mass averaged temperature of about 1200 ° to 2000° K. for a period of about 10 to 200 milliseconds while the carrier gas reaches a mass averaged temperature not greater than about 500° K. less than that of the particles. The particles are raised to substantially their maximum temperature within a period of about 1 to 100 milliseconds.

The soluble fraction produced in accordance with the invention may reside in part inside the particles as well as comprising particles of polymerized condensed volatiles resulting from lower, but still substantial, radiative heating of condensed volatiles, together with unpolymerized condensed volatiles. It is advantageous if polymerization is reduced or maintained at its minimum.

Since absorption of thermal radiation is involved, the relative amounts of radiative heating of coal particles and condensed volatiles is a function of the wavelength of the radiation employed. This relates to the small size of volatile condensation particles relative to the parent coal particles and size dependence of spectral absorptivity. Also, vapor phase volatiles can be expected to show the classic organic absorption peaks, such as C—H and C—C bond stretch. Avoidance of radiative input in such bands decreases heating of vapor phase material, and contributes to its stabilization in the carrier gas. Use of economical sources of spectrally-concentrated radiation is advantageous and is contemplated such as, for example, for commercially-practical coal processing in accordance with the invention.

Certain inorganic salts have relatively narrow bands of emissivity and absorptivity in the visible and infrared regions, and they radiate predominantly at those wavelengths when heated. The well-known Welsbach mantle provided an efficient visible light source in the "gas-light era", and such materials as silica and other mechanically strong materials show marked peaks at various wavelengths in the infrared. Many of these materials have been studied, and the results, for example, reported by Coblentz in his papers "Investigations of Infrared Spectra", shortly after the turn of the century. Since some heated materials radiate strongly where others are transparent, coal or other materials may be subjected in accordance with the invention to radiation having a spectral distribution optimized to produce strong heating of the solid material with minimal heating of condensed volatiles and vapor phase volatiles. The spectral distribution may, where appropriate, be that of a black body.

Thus, in accordance with the invention, in the case of electrically heated reaction tubes for example, they may be made of or lined with a material having the desired spectral emissivity as noted above. For example, to obtain the sharp spectral peak of silica, a reactor tube formed of graphite or silicon carbide used to make furnace tubes could be coated inside with silica.

Alternatively, a combustion flame may be seeded with a silicon compound such as fine silica and allowed to irradiate the interior of a tube of material such as polycrystalline sapphire which might be transparent at the radiated wavelengths. Even if the tube becomes coated with silica, it will cause little harm, except to increase tube heating.

Many other materials having known spectral emissivity are known and may be used, one merely selecting from the many well-known materials, the one having a spectral emissivity best suited for his purposes.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

I claim:

1. A method of treating particulate carbonaceous material to produce a soluble organic fraction comprising:

(a) dispersing particulate carbonaceous material substantially uniformly throughout a carrier gas substantially transparent to radiant energy;

(b) introducing said particulate carbonaceous material and carrier gas into and substantially uniformly throughout an elongated thermal radiator cavity and causing said carbonaceous material and carrier gas to flow through said cavity, said cavity comprising a reactor tube defining a reaction chamber;

(c) heating said reactor tube to generate high intensity radiant energy directed into said reaction chamber sufficient to rapidly, selectively increase the temperature of said particulate material to volatilize volatile constituents of said particulate material; and (d) producing said volatilization of said particulate material while heating said carrier gas to a temperature sufficiently less than that of said material whereby substantially all of said volatilized constituents are rapidly cooled upon leaving the particulate material whereby significant further chemical reactions and decomposition is prevented while said volatilized constituents are resident in said reactor tube.

2. A method of treating particulate carbonaceous material to produce soluble organic fraction comprising:

(a) dispersing particulate carbonaceous material in a carrier gas substantially transparent to radiant energy;

(b) introducing said particulate carbonaceous material and carrier gas into an elongated thermal radiator cavity and causing said carbonaceous material and carrier gas to flow through the central portion of said cavity, said cavity comprising a reactor tube defining a reaction chamber; and (c) heating said reactor tube to generate high intensity radiant energy directed into said reaction chamber sufficient to raise said particulate material to a mass averaged temperature of about 1200 to 2000 degrees Kelvin for a period of about 10 to 200 milliseconds while in said reaction chamber, particle size, density and velocity, gas density and velocity, and characteristics of said cavity being selected to produce said heating of said particulate material while heating said carrier gas to a mass averaged temperature not greater than about 500 degrees Kelvin less than that of said material.

3. A method of treating particulate carbonaceous material to produce a soluble organic fraction comprising:

(a) dispersing particulate carbonaceous material in a carrier gas substantially transparent to radiant energy;

(b) introducing said particulate carbonaceous material and carrier gas into an elongated thermal radiator cavity and causing said carbonaceous material and carrier gas to flow through the central portion of said thermal cavity, said cavity comprising a reactor tube defining a reaction chamber; and (c) heating said reactor tube to generate high intensity radiant energy directed into said reaction chamber sufficient to rapidly raise said particulate material to a mass averaged temperature of about 1200 to 2000 degrees Kelvin within a period of about 1 to 100 milliseconds and maintain said temperature for a period of about 10 to 200 milliseconds while in said reaction chamber, particle size, density and velocity, gas density and velocity, and characteristics of said cavity being selected to produce said heating of said particulate material while heating said carrier gas to a mass average temperature not greater than about 500 degrees Kelvin less than that of said particulate material.

4. The method as called for in claim 1 wherein said selective volatilization of said particulate material and heating of said carrier gas are produced by controlling particle size, density, and velocity, gas density and velocity and characteristics of said cavity.

5. The method as called for in claim 1 and additionally including introducing the output from said reaction chamber into a quench zone to rapidly cool the constituents of said output below their reaction temperature.

6. The method as called for in claim 1 and additionally including generating said radiant energy with a spectral distribution producing substantially minimum heating of products resulting from heating said particulate material.

7. The method as called for in claim 6 wherein said spectral distribution is substantially that of a black body.

8. The method as called for in claim 1 and additionally including flowing a gas at least substantially transparent to said radiant energy substantially uniformly over the inner surface of said reactor tube sufficient to maintain substantially at a minimum heating of the carrier gas and associated particulates by conduction or convection from said reactor tube.

9. The method as called for in claim 1 and additionally introducing a chemically reactive quenchant.

10. The method as called for in claim 1 and additionally including mixing the output of said reaction chamber with a solvent capable of dissolving said volatilized constituents.

11. The method as called for in claim 10 and additionally including separating said dissolved volatilized constituents from said solvent.

12. The method as called for in claim 2 and additionally including generating said radiant energy with a spectral distribution from the thermal radiator substantially that of a black body.

13. The method as called for in claim 2 wherein said carrier gas includes at least a component which reacts chemically with the pyrolysate from said particulates under the conditions in the reactor tube.

* * * * *